US011320137B2

(12) United States Patent
Gantz et al.

(10) Patent No.: US 11,320,137 B2
(45) Date of Patent: May 3, 2022

(54) NECK SUPPORTED CHEST AND BACK MOBILE LIGHTING SYSTEM

(71) Applicant: Ubavu, LLC, Northbrook, IL (US)

(72) Inventors: Christopher Gantz, Northbrook, IL (US); Russ Knize, St. Charles, IL (US); Peter J. Gilbert, Scituate, MA (US); Ron Theis, Kewaskum, WI (US); Kevin Gantz, Laguna Beach, CA (US)

( * ) Notice: Subject to any disclaimer, the term of this patent is extended or adjusted under 35 U.S.C. 154(b) by 0 days.

(21) Appl. No.: 17/034,961

(22) Filed: Sep. 28, 2020

(65) Prior Publication Data

US 2021/0095845 A1 Apr. 1, 2021

Related U.S. Application Data

(60) Provisional application No. 62/906,504, filed on Sep. 26, 2019.

(51) Int. Cl.

| | |
|---|---|
| ***F21V 33/00*** | (2006.01) |
| ***A41D 13/01*** | (2006.01) |
| ***F21V 23/04*** | (2006.01) |
| ***A41D 1/00*** | (2018.01) |
| ***A41D 13/00*** | (2006.01) |
| ***F21W 111/10*** | (2006.01) |
| ***F21Y 115/10*** | (2016.01) |

(52) U.S. Cl.

CPC ..... *F21V 33/0008* (2013.01); *A41D 1/002* (2013.01); *A41D 13/0007* (2013.01); *A41D 13/01* (2013.01); *F21V 23/0464* (2013.01); *F21W 2111/10* (2013.01); *F21Y 2115/10* (2016.08)

(58) Field of Classification Search

CPC ..... F21V 33/0008; F21V 23/0464; F21V 23/0442; A41D 1/002; A41D 1/005; A41D 1/04; A41D 13/01; A41D 13/0007; F21W 2111/10

See application file for complete search history.

(56) References Cited

U.S. PATENT DOCUMENTS

| | | | | |
|---|---|---|---|---|
| 10,746,393 | B1 * | 8/2020 | White | G08B 5/004 |
| 2004/0184262 | A1 * | 9/2004 | De Silva | G08B 5/38 362/108 |
| 2005/0045687 | A1 * | 3/2005 | Willows | G08B 5/004 224/637 |

(Continued)

*Primary Examiner* — Alan B Cariaso

(74) *Attorney, Agent, or Firm* — Howard B. Rockman

(57) ABSTRACT

A wearable, torso-worn, hands free multi-illumination system having a fabric harness worn over the shoulders and adjacent the chest and back of a user. The fabric harness has an adjustable aperture to receive the head of the user, and a fastener along the rim of the aperture, where the fastener adjusts the size of the aperture. The fabric harness includes a front panel and a rear panel, with an ambient light and a light sensor mounted on the front panel. An electronic control system is mounted on the fabric harness, including a control board, LEDs, and light sensor. The ambient light and the light sensor are electrically connected to the control board. Switches are mounted to the front panel, and are electrically connected to the control board. An electric power source is removably mounted on the rear panel, and the power source is electrically connected to the control board.

3 Claims, 14 Drawing Sheets

(56) References Cited

U.S. PATENT DOCUMENTS

| | | | | |
|---|---|---|---|---|
| 2008/0043458 | A1* | 2/2008 | Desjardin | G08B 5/004 362/108 |
| 2010/0313328 | A1* | 12/2010 | Shelton | A41D 13/01 2/102 |
| 2014/0078773 | A1* | 3/2014 | Curran | A41D 1/04 362/555 |
| 2015/0049466 | A1* | 2/2015 | Surpris | F21V 33/0064 362/108 |
| 2018/0137749 | A1* | 5/2018 | Varga | G08B 21/0469 |
| 2020/0022428 | A1* | 1/2020 | Lynch | G08B 5/004 |
| 2021/0102697 | A1* | 4/2021 | Willows | F21V 33/0008 |

* cited by examiner

FIG 8

| | | |
|---|---|---|
| 182 | Switch 1 | **Primary Forward Light**<br>Push 1: HB Low + Rear RED<br>Push 2: HB High + Rear RED<br>Push 3: OFF<br>Push/Hold for 1 Second to turn OFF |
| 184 | Switch 2 | **MAP/Ambient/Courtesy Light**<br>Push 1: Front RED Map<br>Push 2: Front YELLOW Ambient<br>Push 3: Rear Courtesy<br>Push 3: OFF<br>Push/Hold for 1 Second to turn OFF<br>Push/Hold for 5 Seconds to display battery level |
| 186 | Switch 3 | **Sensors**<br>Push 1: Front and Rear Strobe Sensors Active<br>Push 2: OFF<br>Push/Hold for 1 Second to turn OFF |
| 188 | Switch 4 | **Emergency Instant Strobe**<br>Push 1: Front and Rear Strobes on for 10 seconds<br>Push 2: Front and Rear RED Beacon<br>Push 3: Front and Rear Strobes<br>Push 4: OFF<br>Push/Hold for 1 Second to turn OFF |

NECK SUPPORTED CHEST AND BACK MOBILE LIGHTING SYSTEM

CROSS REFERENCE TO RELATED APPLICATIONS

This application claims priority to provisional patent application Ser. No. 62/906,504, filed Sep. 26, 2019, to the extent allowed by law.

FIELD OF THE INVENTION

The present disclosure relates to a light supporting neck harness having controls for various types of lights supported by the harness. The harness also supports several other types of electronic features.

BACKGROUND OF THE INVENTION

There is no single mobile lighting solution that operates independent of head or hand movement and/or also satisfies a large array of illuminating needs based on a user's activity, simultaneous functionality, or auto-sensing capability. Solving this problem, with a comfortable neck harness and light control system, named "Zipray," allows users to have a just one device that can be used for camping, hiking, pet walking, grilling outdoors, biking at night, as a utility light, or any other myriad of tasks or activities that require illumination and the easy control of illumination. To further enhance performance and novelty of the wearable harness structure, in which the multifunctional device is mounted, provides a robust framework for integrating other embodiments via electronic processing and unique applications to control: a microphone for communications, an audio speaker, Bluetooth control to phone and phone apps, sensors to control warning lights, multi button control, multiple light reflector and lens designs, and dynamic light angle directions.

Generally, lighting options for campers, hikers, night time pet walkers or evening gilling are with a handheld flashlight. This limits the user's ability to work with both hands and simultaneously maintain mobility. Newer designs, that affix a light to the user's forehead offer the ability to use both hands while still moving around. These forehead lamp style designs can help lighting areas immediately in front of the user, no matter where they reposition themselves, but they still have limits that the present harness structure solves.

The current market mobile lighting solutions for outdoor activities like camping, pet walking, grilling, or around the house chores are generally in two forms; a handheld flashlight, or a lamp affixed to the head. There's also a third mobile lighting system, albeit less frequently used, whereby a light is hung around the user's neck or clipped on their clothing. All of the current market solutions are not multifunctional, or do not offer more than one simultaneously operated light such as the improved Zipray. Zipray is further unique and improved over current mobile lights by containing an auto light sensing system to trigger warning lights for the users' safe movement around cars and bikers. Each of the market's current mobile lighting solutions have limitations that the Zipray either solves and/or enhances the performance with novel features. Each current mobile lighting solution will be described with its limitations detailed.

i. A handheld light, most commonly referred to as a flashlight, prevents a user's capacity to work with both right and left hands simultaneously, due to one hand relegated to holding the flashlight. If the flashlight is set down, to free up both hands, then the user loses mobility in lighting in various directions and locations. The Zipray overcomes both of these limitations.

ii. The lights that are strapped or affixed to the user's forehead, most commonly referred to as headlamps, has limited use due to their forehead, and hence eyes, must always be pointed toward the task or the target object to be illuminated. A forehead pointed down to the ground, or towards the user's hands, limits the user from having a broader perspective. The head lamp user cannot see both their target object and simultaneously see what's out in front of them. The zipray eliminates this limitation by casting a broad light both at the target and in a wide-ranging spectrum forward the body. A head lamp has other limitations such as when talking with someone, the light beams uncomfortably into the eyes of the individual with whom they are conversing. Further limitations in headlamp designs are: 1.) it directs light only forward, and not behind the user (as an alert or courtesy light), 2.) they're generally a single beam, or single color illumination, 3.) are less comfortably strapped to the head (hair entanglement) and 4.) do not have other electronic or app driven light controls.

iii. A third lighting option, which attaches to the users body by way of clip or neck wrap, has its own set of distinct limitations when compared to the novel functions of the Zipray. We'll call this third type of lighting "body lights". The most common use for body lights is for pet walking or night reading. Body lights are limited to having a single illumination mode, do not have a back light mode, and do not have sensing and associated warning light capability. They also do not have do not have other electronic or app driven light controls.

SUMMARY OF THE INVENTION

The Zipray is advantageous over other mobile lighting systems by way of its unique wearable neck harness structure with integrated lights, sensors, and a processor.

Zipray is designed to be adjustable. It slips over the user's head and zip on both front and back sides until it fits conformably and securely on one's shoulders.

Zipray includes a series of lights mounted on both the front and back sides of the harness. These lights perform multiple functions and are easy to turn on and off using four conveniently placed fabric embedded switches near the front zipper.

Users can switch on forward facing lights to illuminate their forward trail and terrain. Users can switch on an ambient light on the front and back sides at the same time and illuminate a specific area.

Zipray can also be used as a safety/warning device. A single press of a switch provides a beacon or strobe light that can be used for applications such as biking or pet walking. A single push of a switch causes a rapid strobe to illuminate lights on the front and back sides for a duration of 10 seconds and then automatically turns off. The strobes can be set to continuous Beacon pulse mode or a rapid warning strobe Zipray is always hands-free and head-free. Because Zipray is torso mounted users do not need to move their head to adjust or track lighting. Zipray maintains a steady beam of light regardless of any head position. Zipray also has a Beacon and Strobe light designed to be used by bikers and individuals walking near a roadway. A single push of a switch causes a rapid strobe to illuminate front and back sides for 10 seconds and then automatically turn off. The strobes can be set to continuous Beacon pulse mode or a rapid warning strobe. The strobes can be set to display a continuous Beacon pulse mode or a rapid warning strobe mode.

The ambient light on front and back perform the dual function of low-level map light and low level ambient yellow area light. Lights on the front and back can be switched in unison so lights are on at the same time.

Optionally the advantageous features the zipray incorporates, and current hand, forehead and body lighting systems do not offer are:

1. On the back side of the neck harness are additional lights (constant red or blinking red) to warn auto drivers, bikers or runners of a walker that's in front of them 2. The back side offers following hikers a courtesy light to illuminate the trail (if they have no light of their own).

3. Easy body size adjustment with zipper closure (front and back side).

4. Sensors on front and back that detect oncoming lights (auto, bike, etc). once an oncoming light is detected, the signal turns on the red warning lights to forewarn the driver of a pedestrian.

5. Light positions and angles set to be optimum for the work space/job/task without the user having to tilt their head down. Zipray is set at mid chest or sternum and angles are set with memory wire for optimum positioning by bending the wire to the desired angle that fits the user size or project position.

6. Speakers and a microphone mounted on chest, back and or shoulder level to provide music and communications for the user. Amplification of music and connection to a mobile device such as a mobile phone can be via Bluetooth and or wire and plug.

7. Touch screen control of lighting and music

8. Voice command control of lighting and music

9. Integration with mobile application providing extended control such as adjusting lighting levels and lighting color and music tone using an external app 10. Neck harness has batteries located on back portion to balance, counterweight the device 11. Neck harness has collar to incorporate Comfort wicking fabric, Speakers/microphone, rain hood, Cooling belt (hot weather)

12. Water proof electronic and battery housing to 2 meters pressure

13. Vertical slide track to change light position

14. Gimbal frame in place of memory wire to change light angle

15. Body strap or elastic band to restrain neck harness from swinging

16. Clothing clip and magnets to restrain neck harness from swinging

17. Retro-reflective piping or patches built into the fabric or resins

18. Emergency signaling—SOS signaling

19. Citronella/anti bug emitter

20. Bluetooth speaker and microphone for use with music or communications with a mobile phone. Speakers can be mounted on user's front torso, back torso, or shoulders One of the unique capabilities of Zipray is the placement of sensors on the front and back sides. Microprocessor controlled dual sensors monitor light levels on the front and back side searching for vehicle headlights. The second the lights of a car or trucks are detected, strobes fire on both front and back sides, making Zipray a uniquely smart safety product.

DETAILED DESCRIPTION OF THE ILLUSTRATED EMBODIMENTS OF THE INVENTION

Zipray is a wearable lighting system with a multitude of user applications. Zipray can be used for walking a dog at night, to providing light for camping and hiking, as a bike light, and as a utility light for use around the house, or grilling. Zipray is a human body, torso-worn mobile light projection system, that is intended to provide improved lighting and user comfort in comparison to handheld flashlight devices and head-worn lamps. The invention describes a microprocessor-controlled lighting system that is capable of generating variable light intensity levels, light colors and light patterns and sequences. Lighting is controlled by a series of user accessible switches. The unit is powered by batteries and is intended to provide many hours of use without having to recharge or change batteries.

The primary function of the ZipRay is a hands-free mobile lighting used in a variety of applications. The primary function of the light is to illuminate project, terrain, walking trail, as well as the general ambient area surrounding a user. The Zipray can also be used as a safety/warning device and can be used for reading.

Zipray is an improved inventive concept that easily and versatilely hangs comfortably on the user's shoulders, around the user's neck extending to the chest and back area where the lights are located. Zipray allows users the ability to use both hands to work in a lighted space directly in front of them, while have the flexibility and versatility to move their hands or head in any direction or location that they desire without interrupting the targeted illuminated area.

Zipray is designed to be lightweight and is extremely durable and is made of ripstop nylon that's water resistant and breathable. Zipray is perfect for use in inclement weather and great for boating. Zipray is also designed to operate in high and low temperatures of any climate and is sealed from the elements.

Switches are intuitive and easy to use and do not require memorizing multiple push steps or require programming.

Zipray is available in many fabric and housing color combinations.

Figure 1:
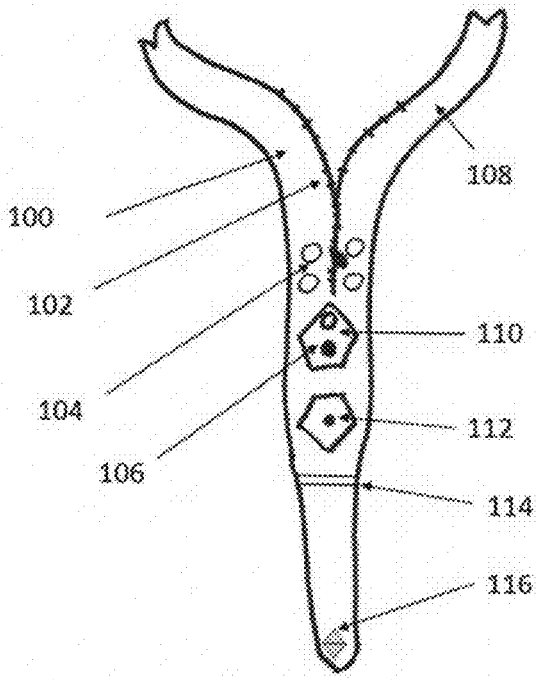
FIG. 1 Front Side view of ZipRay showing primary components

FIG. 1 Front Side view of ZipRay showing primary components. Illustrative point 100 is the front view of the ZipRay fabric assembly that holds all circuits and LED's and connects to the back-side fabric of ZipRay. 102 show the location of the zipper providing for user adjustment for fit and comfort. 104 is a depiction of four fabric mounted switches that control all lights. Additional switches may be added to provide additional functionality such as additional lights, or audio.

Illustrative point 106 is a light module housing that contains the microprocessor control board, led's and sensors. Illustration 110 shows the location of light sensors. 112 shows the position of a multicolor led called the Ambient light. The Ambient light 112, can be dimmed and color changed by the switches 104, so as to provide a red map light color or yellow ambient color. Illustrative point 114 show a folding point for adjustment of the length of the fabric and can be folded up for smaller or shorter users. 116 depicts a magnet and clothing clip with can be used to attach the bottom of the fabric to the users clothing or for shortening the fabric length for smaller and shorter users.

Figure 2:
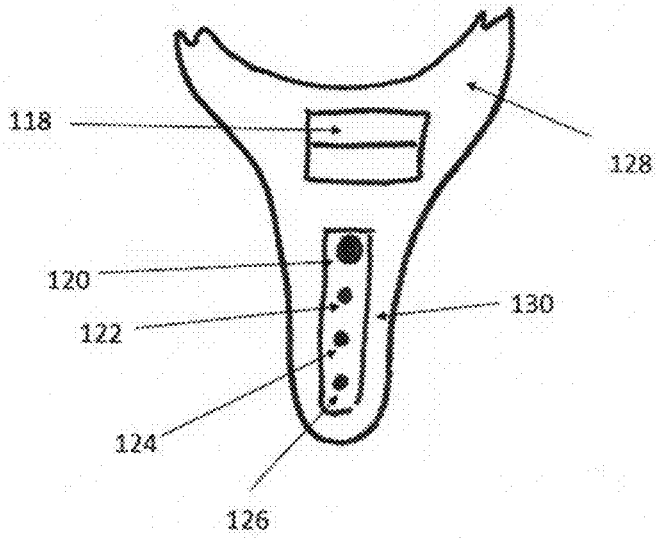
FIG. 2 Back Side view of ZipRay showing primary components

FIG. 2 Back Side view of ZipRay showing primary components. Illustrative point 128 depicts the fabric that holds all electronic and light modules and connects to the front fabric panel of ZipRay. 118 shows the location of the battery module that provides power to all circuits and lights. Illustration 130 shows the location of the back/Rear facing light module. Included in the back rear facing light module 130, are the back light sensor 120, a red beacon or strobe led facing and downward and outward 122, a second red beacon or strobe led facing outward 124, and a yellow ambient/courtesy light 126 that faces downward to provide light to illuminate the ground for individuals who may be following or walking behind the ZipRAY wearer or user.

Figure 3:
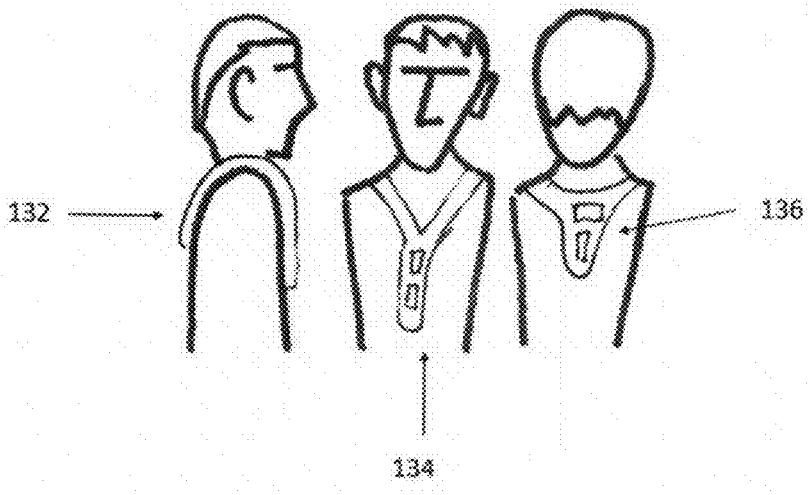
FIG. 3 Side, Front, and Back view of human wearing ZipRAY

FIG. 3 Side, Front, and Back view of human wearing ZipRAY. Illustrative point 132 shows a side view of a user wearing the Zipray. 132 shows the placement of the ZipRay on both the front and back side of a user. 134 is an illustration showing the placement of ZipRAY on a user with the fabric extending from the front side of a user, over the shoulder to connect with the ZipRay fabric on the users back. 136 is an illustration of the back side of the user with the fabric going over the user's shoulder to connect with the fabric of ZipRay.

Figure 4:
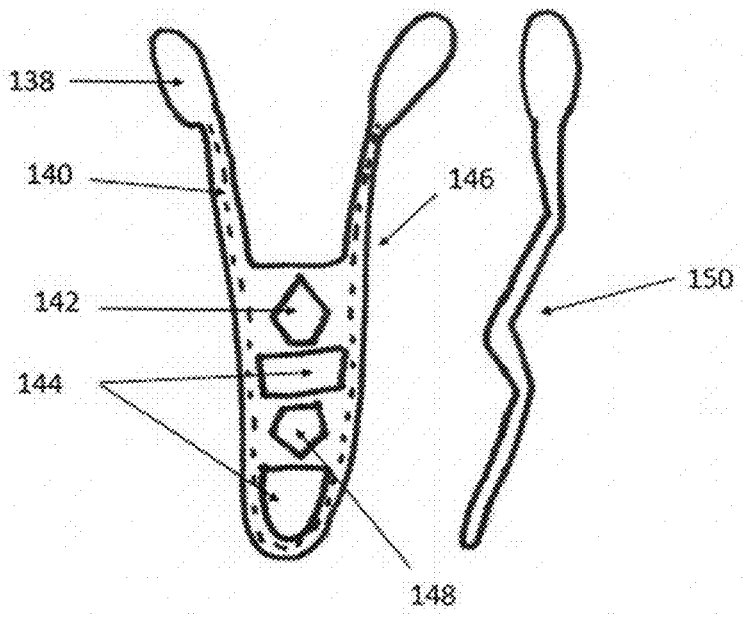
FIG. 4 Flexible Memory Frame and front light modules holder view

FIG. 4 Flexible Memory Frame and front light modules holder view. Illustrative point 146 shows the entire assembly consisting of a flexible metal core (such as iron or steel) covered by a soft rubber elastomer. Illustration 140, shows an internal flexible moldable wire that runs throughout the frame structure. The frame structure is covered with a rubber elastomer type material that provides users with the ability to bend the frame to adjust the led lights of Zipray modules. 138 shows an area of the frame that holds the control switches ZipRay. 142 shows the pocket for mounting ZipRay's front top high beam light, sensor and controller module. 148 shows the location of an area of the frame for mounting the Front bottom Ambient light module. Areas 144 show the location of the absence of material providing a means for easy bending and adjusting the memory wire frame of ZipRay. Illustration point 150 shows how the memory wire core covered with a rubber elastomer can be bent so as to provide the user with a fast and easy means for adjusting the led lights.

Figure 5:
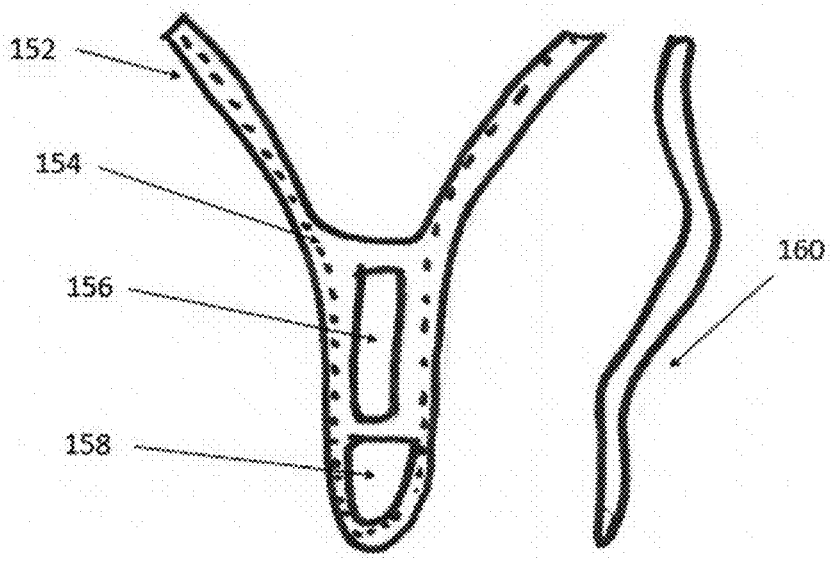
FIG. 5 Flexible Memory Frame, light module and battery holder view

FIG. 5. Flexible Memory Frame, light module and battery holder view. Illustrative point 152 shows the entire assembly consisting of a flexible metal core 154 (such as iron or steel) covered by a soft rubber elastomer. Illustration 154, shows an internal flexible moldable steel or iron wire that runs throughout the frame structure. The frame structure 152 is covered with a rubber elastomer type material that provides users with the ability to bend the frame to adjust the led lights of Zipray modules. 156 shows a pocket for mounting ZipRay's back/rear strobe and courtesy light, sensor. Area 158 shows the location of the absence of material providing a means for easy bending and adjusting the memory wire frame of ZipRay. Illustration point 160 shows how the memory wire core covered with a rubber elastomer can be bent so as to provide the user with a fast and easy means for adjusting the led lights.

Figure 6:
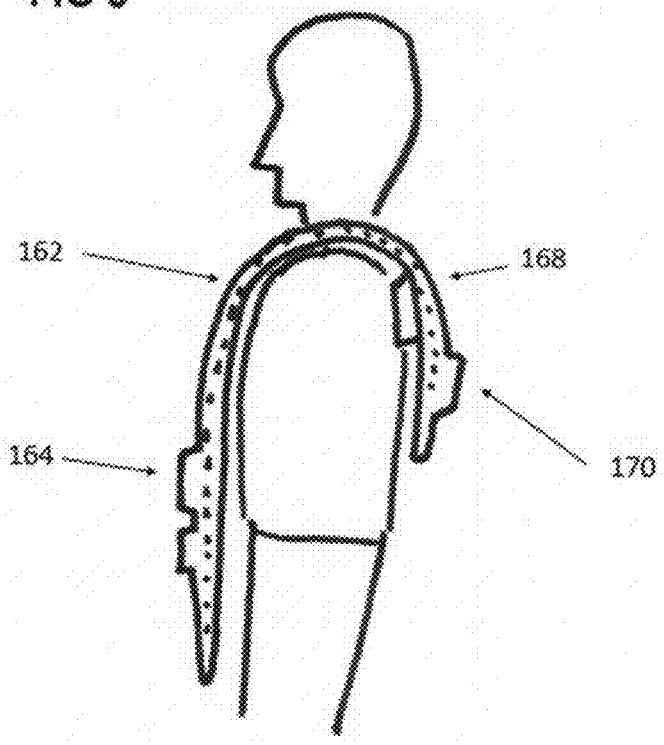
FIG. 6 Wire Cable Channel running from front side, over the shoulder, to back side of Zipray FIG. 7 Control and switches location within the ZipRay fabric FIG. 8 Switch functions for back and front light modules FIG. 9 Front Upper Light Module, sensor, microcontroller, and Bluetooth functional descriptions FIG. 10 Front Lower Light Module function FIG. 11 Back Light Module and Sensor functional description FIG. 12 Bluetooth Application for Light Control by a mobile phone FIG. 13 Audio Speaker and Microphone placement and functional description FIG. 14 Complete front view of ZipRay placed on a human user FIG. 15 Complete back view of ZipRay placed on a human user.

FIG. 6 Wire Cable Channel running from front side, over the shoulder, to back side of Zipray. Illustrative point 162 shows the path of an internal cable containing wires that provide control of the microcontroller light module 164 on the front of ZipRay. The cable is embedded within the ZipRay fabric routed over the shoulder to the back of Zipray 168, and connecting to the back-light module and battery module 170. The cable 162 and 168 is easily removed from the ZipRay providing a means for the user to clean the fabric as well as change fabrics to a different color and style fabric.

Figure 7:
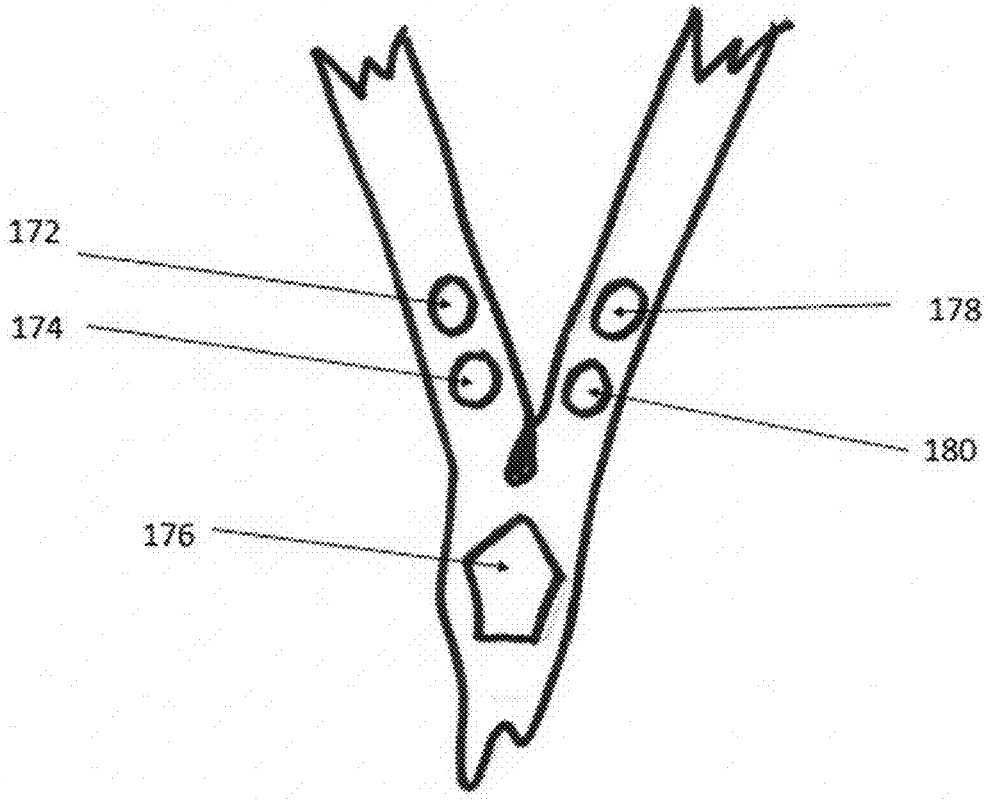

FIG. 7 Control and switches location within the ZipRay fabric. Illustrative points 172, 174, 178 and 180 show locations of switches located within the fabric of ZipRay. All switches are connected the microcontroller light module 176, located on the front side of ZipRay. Additional switches may be located in the same area s 172, 174, 178 and 180, as well as being located within or around and nearby the microprocessor light module 176 located on the front of ZipRay.

FIG. 8 Switch functions for back and front light modules. Illustrative point 182 defines the functionality of switch 1 which controls the lights on the front side of ZipRay. Illustrative point 184 defines the functionality of switch 2 which controls the lights on the front side of ZipRay. Illustrative point 186 defines the functionality of switch 3 which controls the sensors on the front and back side of ZipRay. Illustrative point 188 defines the functionality of switch 4 which controls the lights on the front and back side of Zip Ray.

Pressing and holding any switch for a period of one second or more will turn off all functions including lights and sensors on ZipRay.

Figure 9:
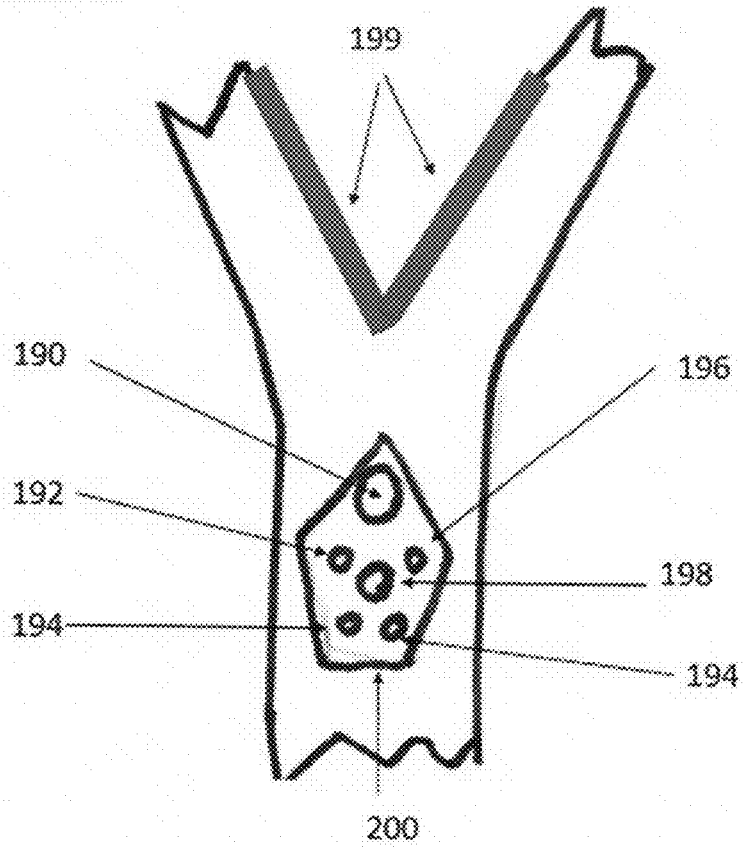

FIG. 9 Front Upper Light Module, sensor, microcontroller, and Bluetooth functional descriptions. Illustration 200 is the upper front light module on Zipray. Illustration 190 is a light sensor which when enabled will monitor light levels in the proximity of the user. When enabled the sensor looks for the presence of bright lights, such as lights from an approaching vehicle. When bright lights are sensed the high beam of the front of the ZipRay is cycled on and off to generate a strobe effect to caution the drivers of a vehicle that a pedestrian or cyclist is nearby. The strobe effect will extinguish within 10 seconds, at which time the sensor 190 is reactivated and continues monitoring for bright lights.

Illustration 192 is a low battery indicator LED. Illustration 196 is a user indicator light that provides confirmation to the user that that led lights on the back of ZipRay are on and active.

Illustration 194 are led indicator lights that provide confirmation of other ZipRay functionality such as Bluetooth being enabled, or the audio speakers and microphones within certain zipray models are enabled.

Illustration 199, depicts the placement of a zipper, hook and loop fasteners, buttons or snaps, allowing for the user adjustment for sizing, comfort and fit of ZipRay.

Figure 10:
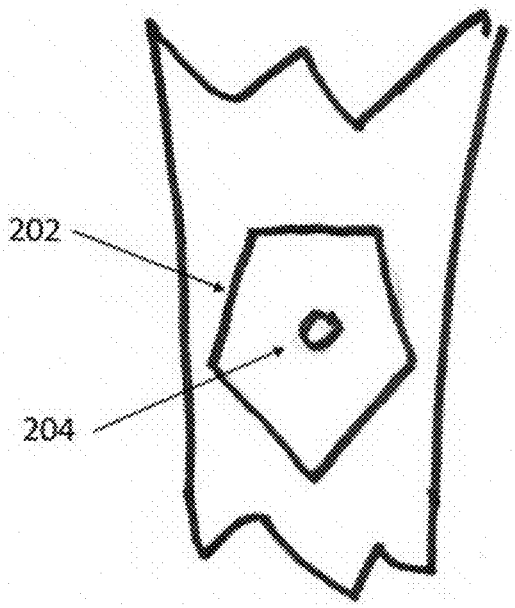

FIG. 10. Front Lower Light Module function. Illustrative point 202 shows the lower front Ambient/Map light module. 204 shows the location of one or more multicolor leds capable of generating over 4000 different colors for use by the user for an ambient, reading, or general-purpose light. Led light 204 can be made brighter or dimer by the user as well as changing colors outputted by the led.

Figure 11:
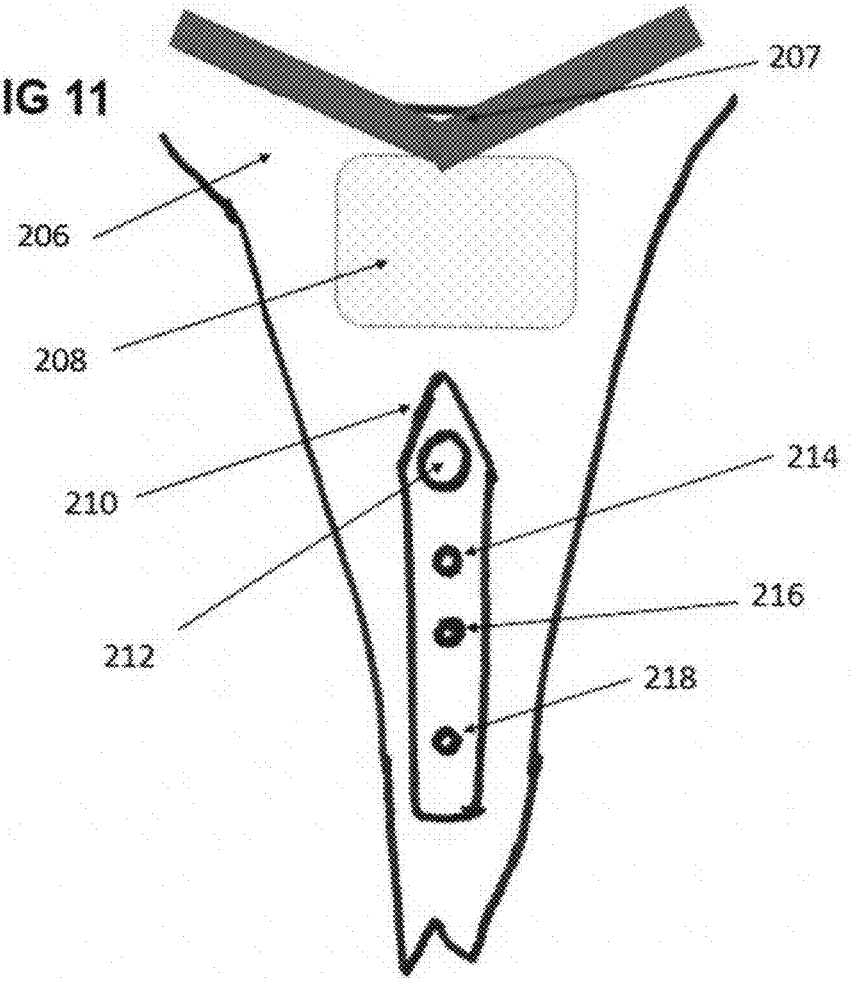

FIG. 11. Back Light Module and Sensor functional description. Illustrative point 206 shows the ZipRay rear light module. Illustration 207 depicts the placement of a zipper, hook and loop fasteners, buttons or snaps, allowing for the user adjustment for sizing, comfort and fit of ZipRay.

Illustrative point 208 shows the location of a battery module within the fabric, providing power to the microcontroller circuit and led's.

Illustration 210 shows the back/rear light module containing combinations of color and multifunction LED's light and sensor. Illustration 212 shows the location of a sensor that functions the same as the sensor located on the front of ZipRay. 212 is a light sensor which when enabled will monitor light levels in the proximity of the user. When enabled the sensor looks for the presence of bright lights, such as lights from an approaching vehicle. When bright lights are sensed the high beam of the front of the ZipRay is cycled on and off to generate a strobe effect to caution the drivers of a vehicle that a pedestrian or cyclist is nearby. The strobe effect will extinguish within 10 seconds, at which time the sensor 190 is reactivated and continues monitoring for bright lights.

Illustration 214 is a downward facing led which can project a strobe or pulse beacon effect at a 45-degree angle. The downward angle of projection compensates for users riding a bicycle or motorcycle while leaning forward, or a user walking or running in the a forward leaning prone position. The 45-degree projection angle provides for a direct horizontally projected light making it easy for drivers of vehicles to see the led caution or warning light of the ZipRay. 216 is a back horizontally mounted LED providing a different angle of light projection (from LED 214). 218 is a downward facing 45-degree light projecting LED that can be used as a caution light or provide a means of illuminating the ground for a person walking behind the ZipRay user.

Figure 12:
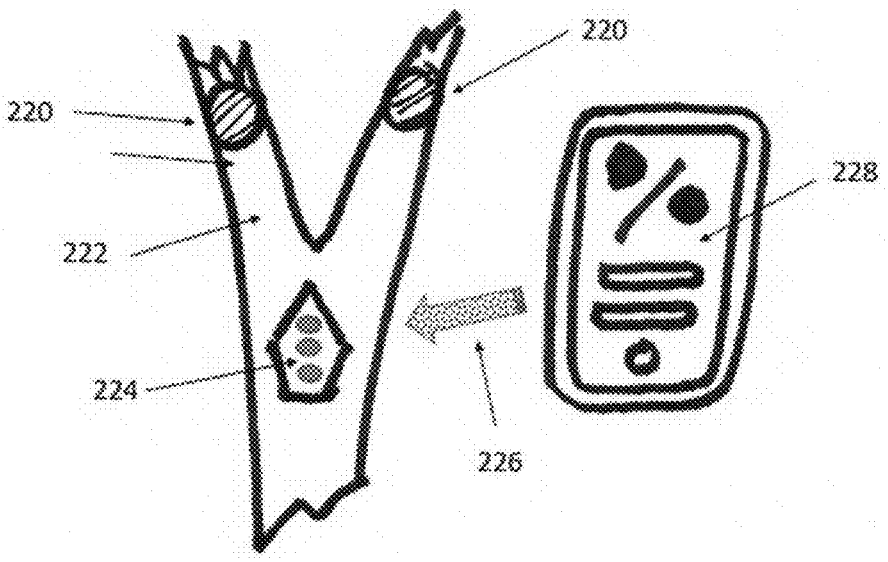

FIG. 12 Bluetooth Application for Light and Audio Control by a mobile phone. Using a mobile phone 228 configured with Bluetooth will provide the user a means of controlling the Bluetooth circuit located withing the front microcontroller, sensor, light module on ZipRay. The mobile phone user can download an app into the mobile phone 228, that can communicate via a radio frequency 226 to the ZipRay. Bluetooth functionality provides a means for the ZipRay user to control the light 224 being output by all light modules as well as the volume of sound being generated by speakers 220 and microphones 222, located within the fabric of ZipRay.

Figure 13:
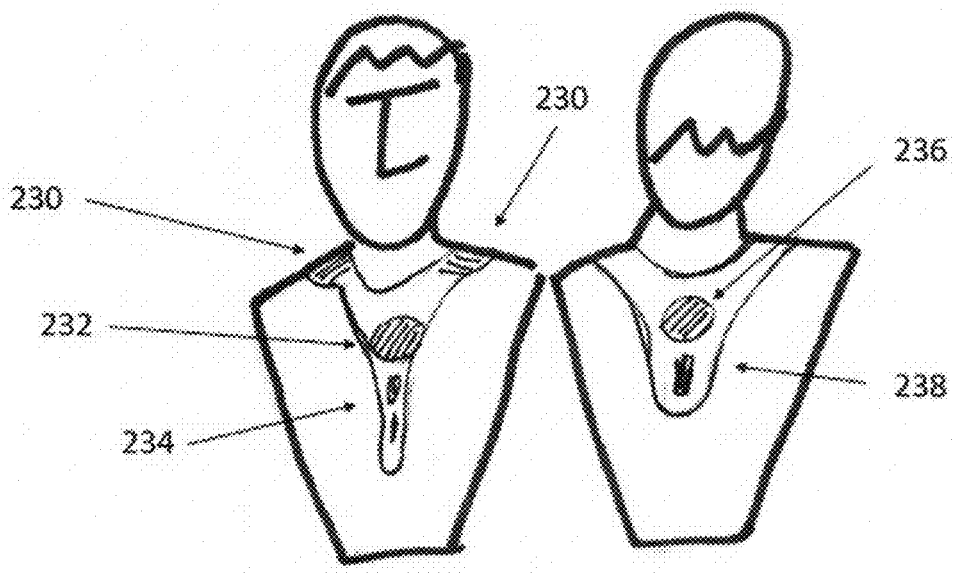

FIG. 13 Audio Speaker and Microphone placement and functional description. Zipray will have several configurations that provide for placement of speakers and microphones at the shoulder level 230, on the front of zipray 232 and on the back of the zipray fabric 236. Speakers and microphones will be positioned and located above the light modules 234 and 238 on the front and back side of the Zipray.

Figure 14:
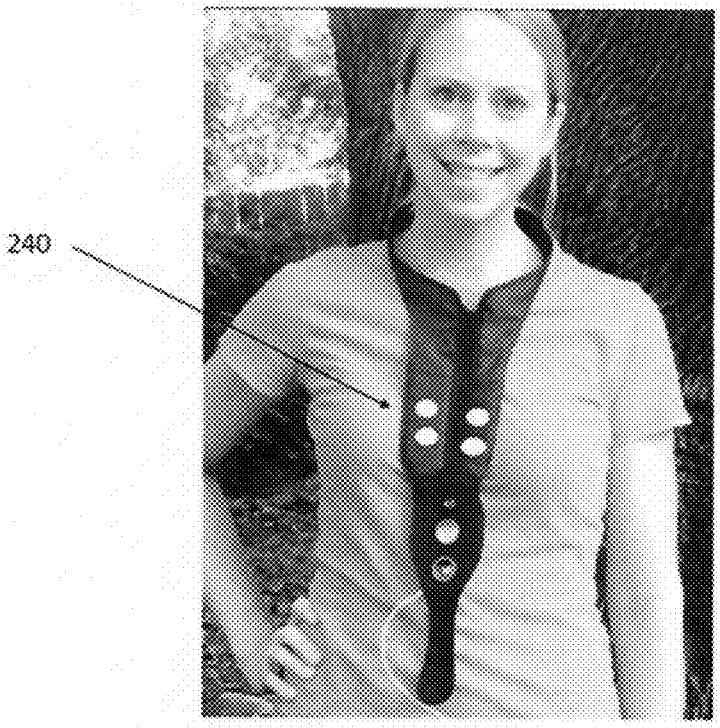

FIG. 14 Complete front view of ZipRay placed on a human user. Illustration 240, shows the front view of a ZipRay worn by a user.

Figure 15:
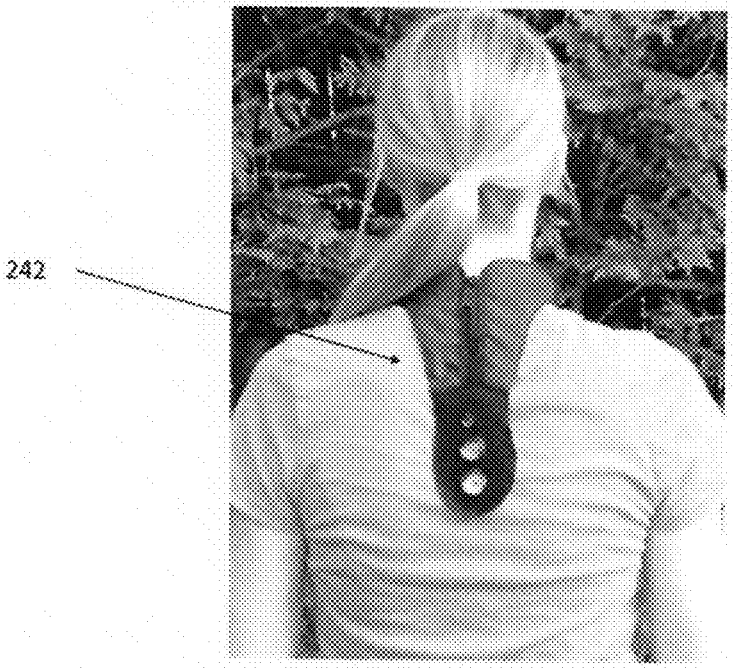

FIG. 15 Complete back view of ZipRay placed on a human user. Illustration 242, shows the back view of a ZipRay worn by a user

We claim:

1. A wearable, torso-worn, hands-free multi-illumination system, comprising:

a. a fabric harness configured to be worn over the shoulders and adjacent the chest and back of a user, the fabric harness having an adjustable aperture to receive the head of the user, a fastener adjacent a rim of the aperture, the fastener adjusting the size of the aperture;

b. the fabric harness having a front panel and a rear panel;

c. at least one ambient light mounted on the front panel;

d. at least one light sensor mounted on the front panel;

e. an electronic control system housing mounted on the fabric harness, the electronic control system including a control board, LEDs, and the at least one light sensor, the at least one ambient light and the at least one light sensor electrically connected to the control board; and f. at least one switch mounted to the front panel of the fabric harness, the at least one switch electrically connected to the control board, to the at least one light sensor, and to the at least one ambient light;

at least one rear facing light module, at least one beacon light, and at least one ground-facing light are mounted on the rear panel; and each of the at least one rear facing light module, the at least one beacon light, and the at least one ground-facing light are electrically connected to the control board.

2. The wearable torso-worn, hands-free multi-illumination system of claim 1, wherein:

an electric power source is removably mounted to one of the front panel and the rear panel of the fabric harness; the electric power source electrically connected to the control board.

3. The wearable torso-worn, hands-free multi-illumination system of claim 1, wherein:

a flexible memory frame extends through a portion of the flexible harness.

* * * * *